US005622120A

United States Patent [19]

Yeh

[11] Patent Number: 5,622,120

[45] Date of Patent: Apr. 22, 1997

[54] COMPOSITE APRON FOR A TABLE

[76] Inventor: Don-Fong Yeh, 8F, No. 65, Sung-Chiang Rd., Chung-Shan Dist., Taipei City, Taiwan

[21] Appl. No.: 608,754

[22] Filed: Feb. 29, 1996

[51] Int. Cl.[6] ..... A47B 47/00

[52] U.S. Cl. ..... 108/156; 108/153

[58] Field of Search ..... 108/153, 154, 108/155, 158

[56] References Cited

U.S. PATENT DOCUMENTS

| | | | |
|---|---|---|---|
| 3,341,160 | 9/1967 | Jones, III | 108/156 |
| 3,875,712 | 4/1975 | Thompson | 108/153 |
| 4,585,365 | 4/1986 | Manno | 108/153 |
| 5,533,788 | 7/1996 | Nottingham et al. | 108/156 |

*Primary Examiner*—Peter M. Cuomo

*Assistant Examiner*—Gerald A. Anderson

*Attorney, Agent, or Firm*—Ladas & Parry

[57] ABSTRACT

A composite apron for a table can be fixed to a bottom surface of the table top between adjacent two of the legs. The apron includes a generally U-shaped wooden shell and a molded core embedded in the shell. The shell and the molded core are hot pressed together. The shell has an elongated vertical main plate section with a vertical inward surface and a vertical outward surface, two vertical end plate sections respectively and perpendicularly projecting from two ends of the inward surface of the main plate section so that the main plate section and the end plate sections cooperatively form a U shape, and a horizontal plate section projecting perpendicularly from a middle portion of the inward surface of the main plate section. When fixed on the bottom surface of the table top, the end plate sections of the shell respectively abut against and are secured to the adjacent two of the legs, while the horizontal plate section abuts against and is secured to the bottom surface of the table top.

3 Claims, 3 Drawing Sheets

COMPOSITE APRON FOR A TABLE

BACKGROUND OF THE INVENTION

1. Field of the Invention

The invention relates to an apron, more particularly to a composite apron for a table.

2. Description of the Related Art

Conventional furnitures are usually made of wood. However, in view of the current emphasis on environmental protection, there is always a need to find another material that can serve as a substitute for wood in the furniture industry.

Referring to FIG. 1, a conventional wooden table is shown to comprise two pairs of aprons 3 and four table legs 1. Each of the table legs 1 has a top end with a connecting block 2 mounted thereon. The two ends of the connecting block 2 are mounted respectively on an adjacent pair of the aprons 3. A table top 4 is mounted on the top ends of the aprons 3.

Since the conventional aprons 3 are made entirely of wood, the material cost of the aprons 3 is relatively high due to the limited supply of lumber. In addition, the aprons 3 have to undergo numerous operations in order to attain the desired shape and appearance, thereby resulting in a very slow manufacturing process and in a relatively high manufacturing cost. Moreover, the aprons 3 are inconvenient to install due to the fact that they are normally secured to the connecting block 2 with the use of screws. Furthermore, boring of the aprons 3 is needed to form screw holes. This can weaken and damage the aprons 3.

SUMMARY OF THE INVENTION

The object of this invention is to provide a relatively inexpensive composite apron which can be conveniently processed so as to attain a desired shape and appearance, thereby resulting in a relatively low manufacturing cost.

Another object of this invention is to provide a composite apron which can be easily connected to the table top.

Accordingly, a composite apron for a table of this invention is adapted to be fixed to a bottom surface of the table top between adjacent two of the legs. The apron includes a generally U-shaped wooden shell, and a molded core embedded in the shell. The shell and the molded core are hot pressed together. The shell has an elongated vertical main plate section with a vertical inward surface and a vertical outward surface, two vertical end plate sections respectively and perpendicularly projecting from two ends of the inward surface of the main plate section so that the main plate section and the end plate sections cooperatively form a U shape, and a horizontal plate section projecting perpendicularly from a middle portion of the inward surface of the main plate section. When fixed on the bottom surface of the table top, the end plate sections of the shell respectively abut against and are secured to the adjacent two of the legs, while the horizontal plate section abuts against and is secured to the bottom surface of the table top.

BRIEF DESCRIPTION OF THE DRAWINGS

Other features and advantages of this invention will become more apparent in the following detailed description of the preferred embodiments with reference to the accompanying drawings, of which.

DETAILED DESCRIPTION OF THE PREFERRED EMBODIMENT

Figure 1:
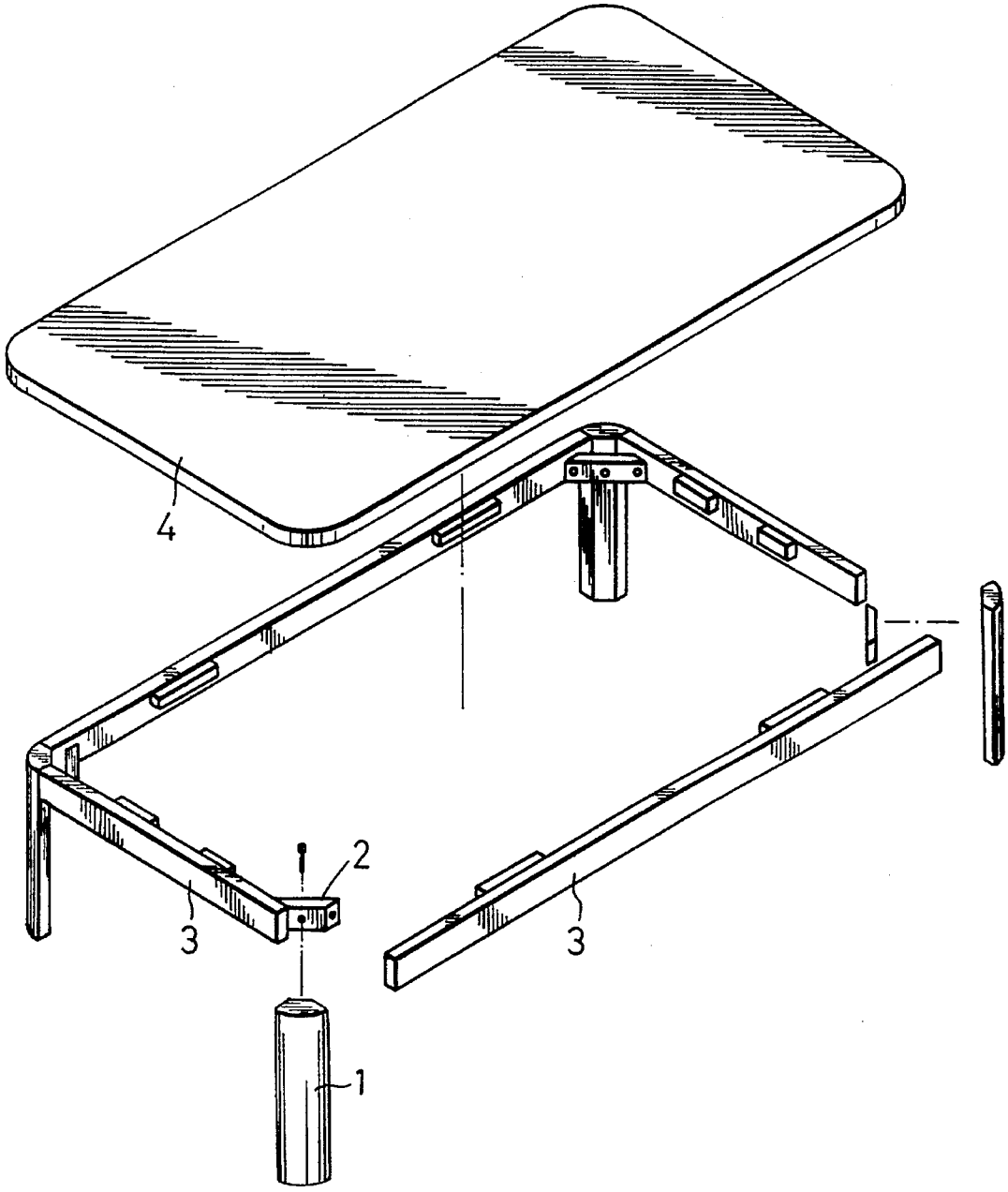
FIG.1 PRIOR ART
FIG. 1 is an exploded view of a conventional wooden table.
Figure 2:
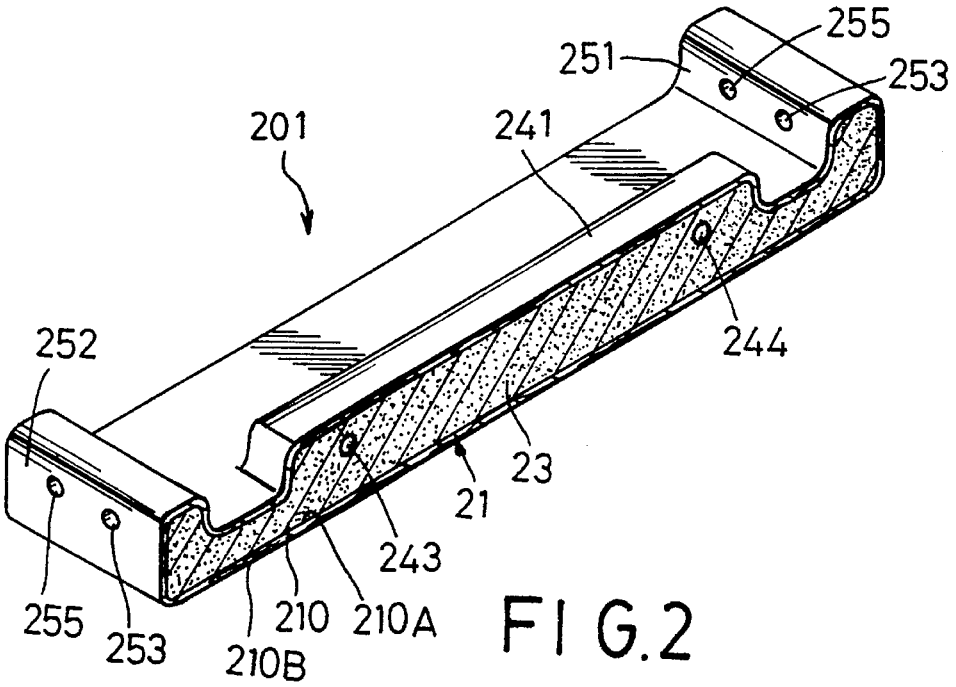
FIG. 2 is a perspective view of a composite apron of this invention.
Figure 4:
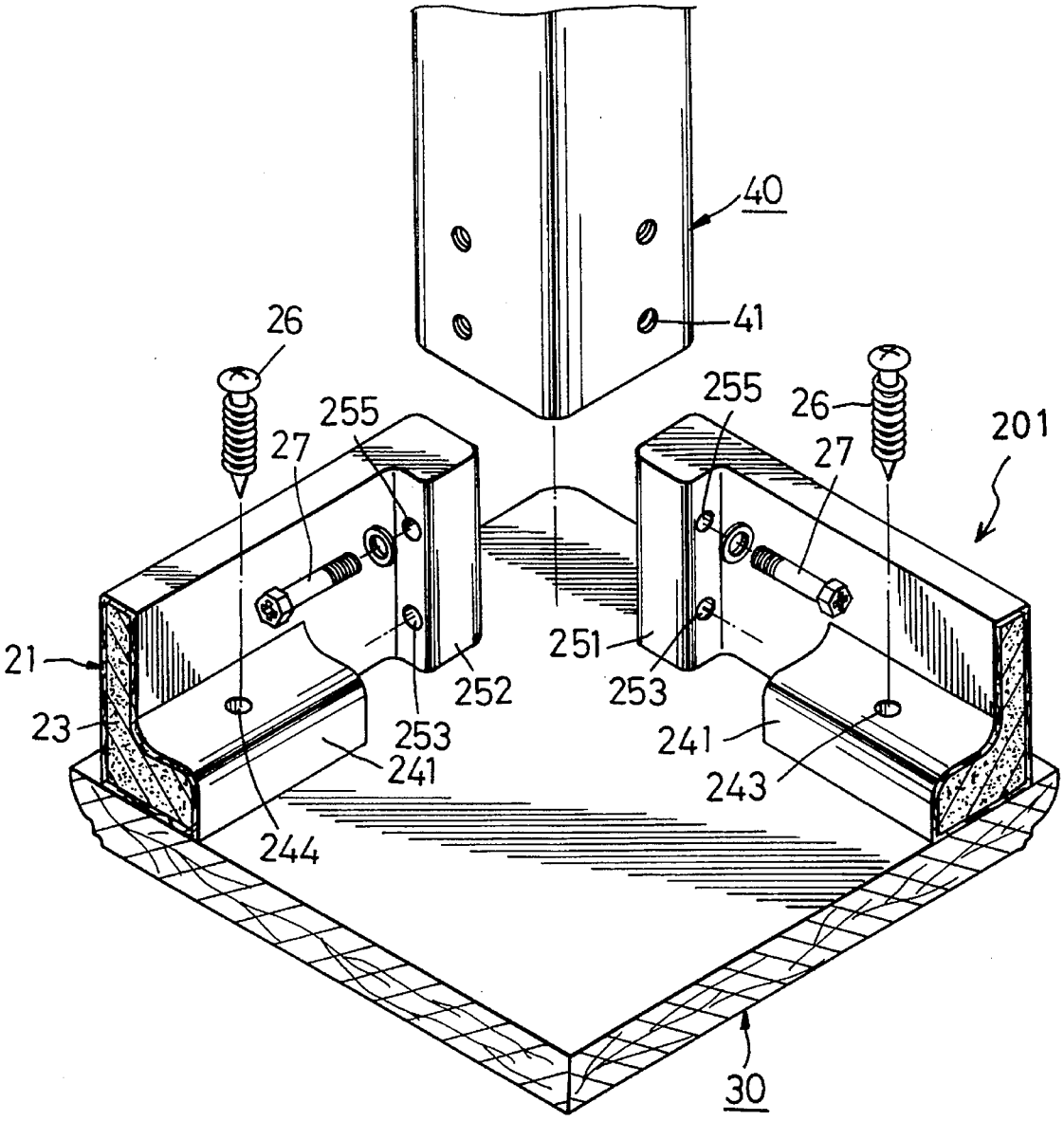
FIG. 4 is a schematic view illustrating how the preferred embodiment of two aprons according to this invention are connected to the table top and the legs.

As illustrated in FIGS. 2 and 4, the preferred embodiment of a composite apron 201 according to this invention is adapted to be fixed on a bottom surface of a table top 30 so as to extend between adjacent two of the legs 40 of a table.

The apron 201 includes a generally U-shaped wooden shell 21, and a molded core 23 embedded in the shell 21. The shell 21 has an elongated vertical main plate section 210 with a vertical inward surface 210A and a vertical outward surface 210B, and two vertical end plate sections 251, 252 respectively and perpendicularly projecting from two ends of the inward surface 210A of the main plate section 210 so that the main plate section 210 and the end plate sections 251, 252 cooperatively form a U shape. The shell 21 further has a horizontal plate section 241 which projects perpendicularly from a middle portion of the inward surface 210A of the main plate section 210. Each of the end plate sections 251, 252 and the horizontal plate section 241 of the shell 21 has two holes 243, 244, 253, 255.

Referring to FIG. 4, during assembly of a table, four aprons 201 are mounted to the bottom surface of the table top 30 in such a manner that each of the aprons 201 extends between adjacent two of the legs 40 (only one is shown). Two bolts 27 extend through the holes 253, 255 in the end plate sections 251, 252 of the shell 21 and are threaded in the holes 41 of the leg 40, thereby securing the apron 201 on the leg 40. Another pair of bolts 26 extend through the holes 243, 244 in the horizontal plate section 241 of the shell 21 and are threaded to the table top 30. Thus, the end plate sections 251, 252 of the shell 21 respectively abut against the adjacent two of the legs 40 while the horizontal plate section 241 abuts against the bottom surface of the table top 30.

Figure 3:
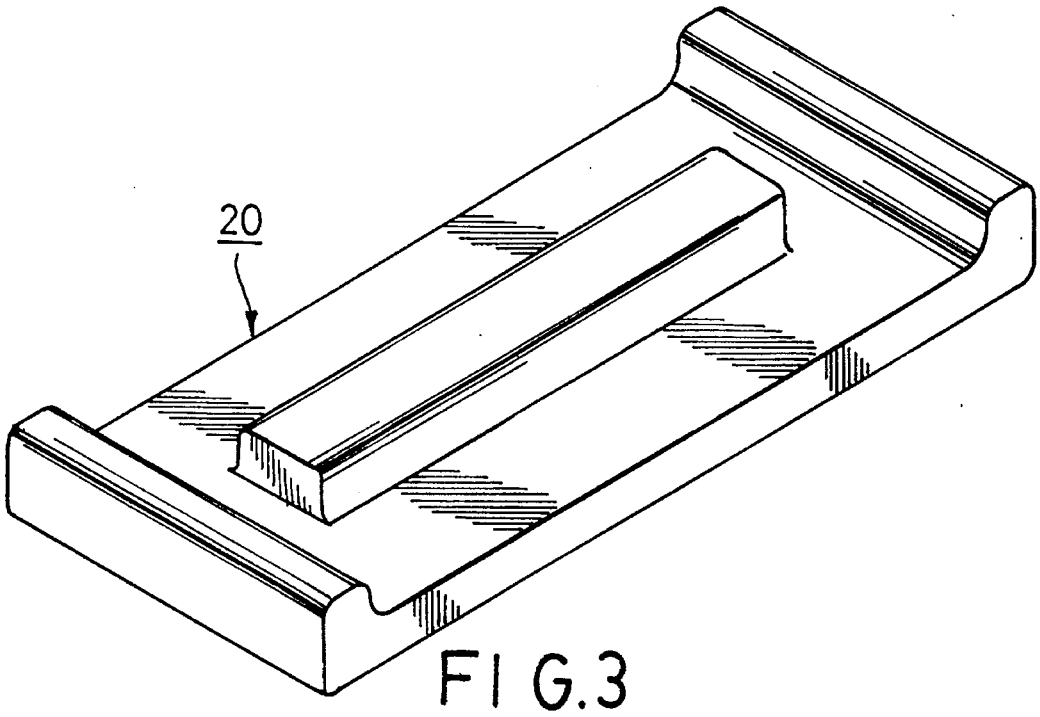
FIG. 3 is a composite article which is cut lengthwise thereof so as to form two composite aprons of this invention.

Referring to FIG. 3, in manufacture, a lower wooden sheet, a core piece formed by a mixture of wood chips and a resinous binder, and an upper wooden sheet are placed in a mold and are hot pressed together, so as to form a molded product 20 which is then cut into two aprons shown in FIG. 2.

The advantages and characterizing features of the composite apron according to this invention are as follows:

1. The molded core 23 is made primarily from waste material and is therefore environmental friendly and has a relatively low cost as compared to the traditional apron made entirely from wood.

2. There is no need for the apron to undergo several complicated operations so as to attain a desired shape and appearance, thereby reducing largely the manufacturing cost.

3. Since the holes in the apron are readily formed during the hot pressing and molding processes, boring of the holes is not needed, thus reducing the assembly time for the table.

With this invention thus explained, it is obvious to those skilled in the art that various modifications and variations can be made without departing from the scope and spirit thereof. It is therefore intended that this invention be limited only as in the appended claims.

I claim:

1. An apron for a table, the table including a horizontal table top and several vertical legs of a rectangular cross-section mounted on the table top, the apron being adapted to be fixed to a bottom surface of the table top between adjacent two of the legs, wherein the improvement comprises:

the apron including a generally U-shaped wooden shell and a molded core which is embedded in the shell, the shell and the core being hot pressed together, the shell having an elongated vertical main plate section with a vertical inward surface and a vertical outward surface, two vertical end plate sections respectively and perpendicularly projecting from two ends of the inward surface of the main plate section so that the main plate section and the end plate sections cooperatively form a U shape, and a horizontal plate section projecting perpendicularly from a middle portion of the inward surface of the main plate section, the end plate sections of the shell being adapted to respectively abut against and be secured to the adjacent two of the legs, the horizontal plate section being adapted to abut against and be secured to the bottom surface of the table top.

2. The apron as defined in claim 1, wherein each of the end plate sections and the horizontal plate section has two holes formed therethrough and adapted to permit extension of two bolts therethrough in order to mount the apron on the adjacent two of the legs and in order to mount the apron on the table top.

3. The apron as defined in claim 1, wherein the core is formed by hot pressing a mixture of wood chips and a resinous binder.

* * * * *